United States Patent [19]

Dorn

[11] 4,002,240

[45] Jan. 11, 1977

[54] COMBINED BOOKRACK AND BOOK SUPPORT

[76] Inventor: Edward G. Dorn, 145 S. Belle Ave., Palatine, Ill. 60067

[22] Filed: Apr. 10, 1975

[21] Appl. No.: 566,697

[52] U.S. Cl. ..... 211/42; 211/181; 248/175; 248/441 R

[51] Int. Cl.[2] ..... A47B 65/00

[58] Field of Search ..... 211/11, 10, 13, 42, 211/43, 40, 181; 248/441, 442.2, 447, 448, 454, 457, 459, 460, 127, 174, 175

[56] References Cited

UNITED STATES PATENTS

| | | | |
|---|---|---|---|
| 1,455,524 | 5/1923 | Fargo | 211/42 |
| 1,488,282 | 3/1924 | Phillips | 211/42 |
| 1,682,060 | 8/1928 | Banks | 211/42 |
| 2,205,064 | 6/1940 | Irwin | 211/40 X |
| 3,318,453 | 5/1967 | Cavanaugh | 211/42 X |

FOREIGN PATENTS OR APPLICATIONS

| | | | |
|---|---|---|---|
| 793,578 | 11/1935 | France | 211/42 |
| 1,041,446 | 9/1966 | United Kingdom | 211/40 |

*Primary Examiner*—Roy D. Frazier
*Assistant Examiner*—Terrell P. Lewis
*Attorney, Agent, or Firm*—Dennison, Dennison, Meserole & Pollack

[57] ABSTRACT

A metal rod or bar frame configured to provide an elongated base member with opposed laterally directed end members. The base member includes a first surface which, when upwardly directed, is defined by two angularly related planar portions oppositely inclined downward and outward from a central point, the end members projecting vertically upward therefrom in the manner of book ends. The lower surface of the base member parallels the upper surface and, upon an inverting of the device, provides an elevated wide trough for the support of an open book.

3 Claims, 7 Drawing Figures

COMBINED BOOKRACK AND BOOK SUPPORT

The invention herein generally relates to a book retaining stand, and is more particularly concerned with a combined bookrack and book support capable of, in one position, positively retaining upright books against fixed book ends, and in an inverted position, forming an elevated support for an open book.

A particularly significant object of the present invention is to provide a unique bookrack, incorporating fixed book end portions, wherein one or more books can be positioned in a manner whereby the books are positively retained in an upright and easily accessible position without necessitating a clamping of the books between adjustable book ends or, alternatively, the tilting or balancing of the individual books in a manner which is both unattractive and detrimental to the book itself.

Another highly significant object of the invention is to provide a bookrack which is so constructed as to, upon an inverting thereof, define a wide elevated support for an open book, the support incorporating angled base portions which cradle the book in an open position and allow for a turning of the pages and a retention of the book in a manner so as to completely expose the page contents.

The above objects are generally achieved through the provision of a book retaining rack defined by a rod or bar frame configured so as to provide an elongated base member having, in the bookrack orientation, a high central point and oppositely inclined portions which terminate in upright end members defining book ends. In this configuration, any upright book, tape cartridge, or the like positioned on a portion of the base member will automatically move down the inclined portion and engage flush against the upright end member. Positioned in this manner, the book or the like will be positively supported and retained without the necessity of utilizing a second end member directly engaged thereagainst as in the manner of conventional bookracks, book ends of the like. Further, with this arrangement, intermediate books can be easily removed with the remaining books, either through their own weight or with a little physical movement of the books by the user, easily slid down the slight incline to the stored stable position against the single end member.

Upon an inverting of the stand, the lower surface of the base member, now upwardly directed, defines a wide trough-like surface, elevated through the now downwardly directed end members, which is particularly adapted to accommodate an open book for a complete display of the contents thereof. In a proposed variation, the vertical legs of each end member can be of unequal length to define an inclined top bar on each end member which, while having no effect when utilizing the end members as book ends, will upon an inverting of the device to the open book supporting position, incline the support slightly so as to facilitate a viewing of the contents of the supported open book.

These together with additional objects and advantages will become subsequently apparent from the following detailed description of the construction and operation of the invention. Reference is had to the accompanying drawings wherein like numerals refer to like parts throughout and in which.

Figure 1:
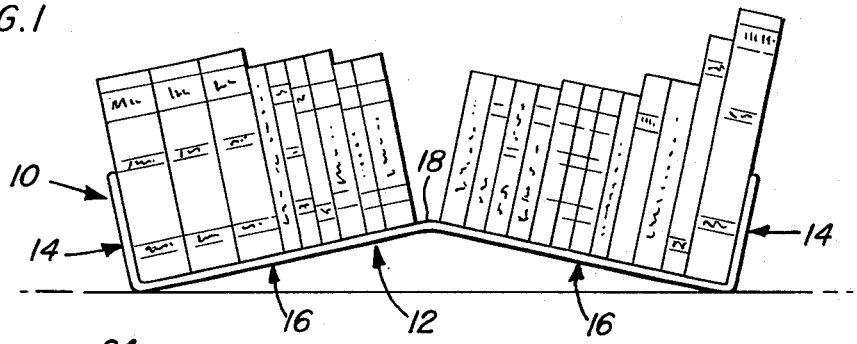
FIG. 1 is a front elevational view of the book retaining stand orientated in an upright position for use as a bookrack.

Referring now more specifically to the drawings, reference numeral 10 is used to generally designate the book retaining stand or combined bookrack and book support. This device includes an elongated base member 12 and a pair of opposed generally laterally projecting end members 14.

Figure 2:
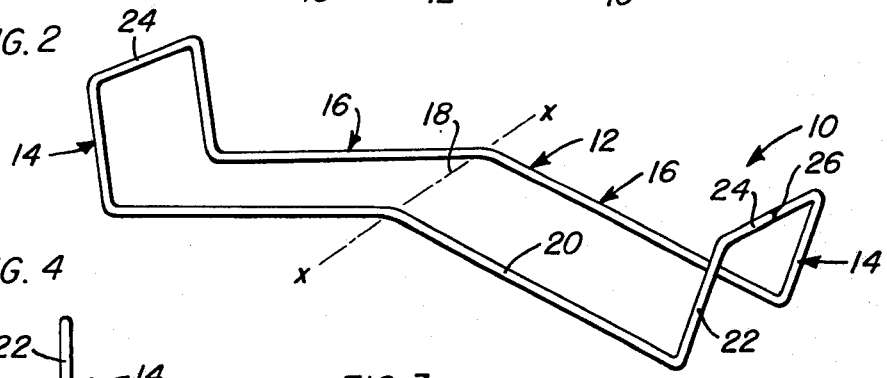
FIG. 2 is a perspective view of the stand orientated as a bookrack.
Figure 5:
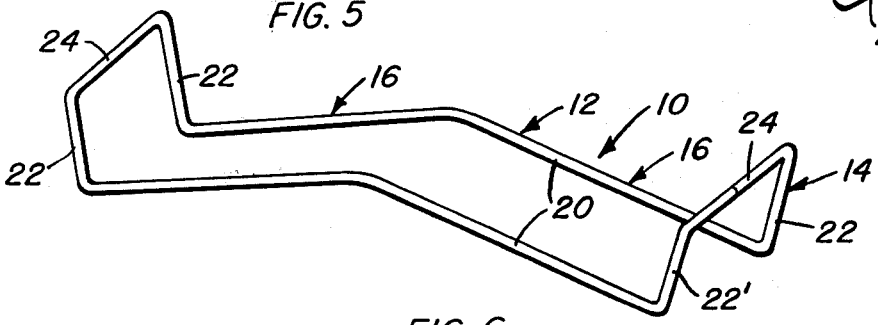
FIG. 5 is a perspective view similar to FIG. 2 illustrating a variation wherein the vertical length of the end member rods are of unequal heights.

Referring to the bookrack orientation of the device 10, as illustrated in FIGS. 1, 2 and 5, the base member 12, including parallel upper and lower surfaces or portions, is defined by a pair of angularly related planar portions or sections 16 oppositely inclined downwardly and outwardly from an intermediate location 18, indicated by imaginary line X—X in FIG. 2. One end member 14 is associated with the outer end of each base member portion 16 and extends upwardly at approximately right angles thereto so as to define fixed book ends.

As will be best appreciated from FIG. 1, the bookrack configured in this manner enables a positive upright support of the individual books against one or the other of the end members 14, the book or books in each instance being fully supported on the lower edge thereof and retained by gravity against the corresponding end member without necessitating either a precarious balancing of an unsupported book on its edge or the tilting of the book, relative to the base member, in a manner which is destructive both to the lower edge and the book binding. With continued reference to FIG. 1, it would also be appreciated that the removal of any intermediate book will position result in the remaining books sliding into stable positin downward against the remaining books or the associated book end. Further, the opposed inclination of the base portions 16 allows, even upon a full loading of the rack, an open central portion for accommodation of the hand or a simplified manipulation of the books for the removal of any particular book or books.

Figure 4:
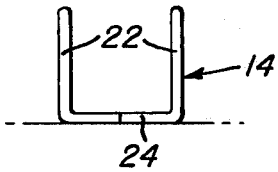
FIG. 4 is an end elevational view of the inverted stand.
Figure 3:
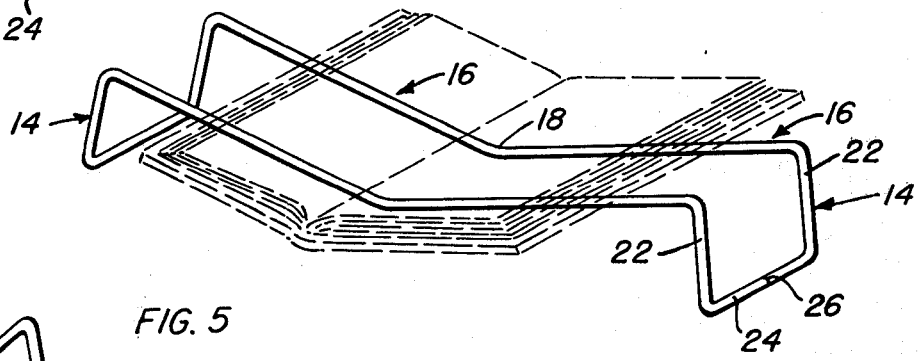
FIG. 3 is a perspective view of the stand inverted for use as a support for an open book.

With reference to FIGS. 3 and 4, it is contemplated that the book retaining stand 10 be invertable and used in its inverted position as a support for an open book, retaining the pages thereof in position for easy viewing. Inasmuch as the opposed surfaces or portions of the base member are parallel, upon an inverting of the device 10, the two portions or sections 16 will, from the central location 18, incline outwardly and upwardly so as to define a slight trough for the reception of the book. By the same token, the inverted end members 14 will depend from the outer ends of the portion 16, at approximately right angles thereto, so as to provide wide spread support legs to maintain the base member 12 elevated.

As noted in the drawings, the device is preferably constructed of a length of metal rod or bar, for example wrought iron, bent so as to initially define laterally spaced parallel base member forming lengths 20, each centrally angled at location 18. Each of the rod lengths, at the opposed ends thereof, is laterally bent so as to define substantially vertical end member rod sections 22 with the outer ends of each end member rod section being interconnected by a transverse rod section 24. As indicated, the entire stand is preferably formed of a single length of rod or bar, and as such, the opposite ends thereof will normally be welded or otherwise secured to each other at some particular point along the frame as suggested at reference numeral 26.

Figure 7:
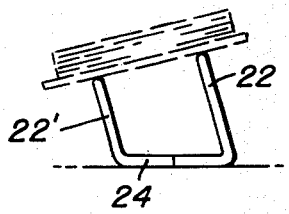
FIG. 7 is an end elevational view of the inverted stand of FIG. 6 illustrating the inclination derived from the unequal height of the end member rods.
Figure 6:
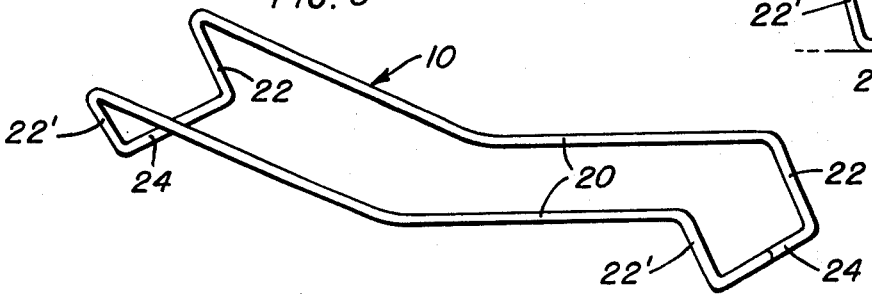
FIG. 6 is an inverted view of the stand of FIG. 5.

Referring now to the variation of FIGS. 5, 6 and 7, in the bookrack or upright orientation of the stand 10 each of the end members 14 has one of the vertical rod sections, herein referred to by reference numeral 22', formed of a lesser height than the second associated vertical rod section 22, thus also resulting in an inclination of the upper interconnecting transverse rod section 24. It will of course be appreciated that the relatively shorter sections 22' are defined at the opposite ends of a single one of the base member lengths 20. While this in no way affects the function of the end members 14 for use as book retaining ends, upon an inverting of the stand 10 as illustrated in FIGS. 6 and 7, the foreshortened rod sections 22', in conjunction with the end interconnecting transverse rod sections 24, will result in a transverse inclination of the book support, and more particularly the trough-like book receiving base member 12, so as to facilitate a viewing and manipulation of the book pages.

From the foregoing, it will be appreciated that a highly unique book retaining stand has been defined. This stand, when utilized as a bookrack, provides for a positive support, utilizing fixed book ends, of one or more books without necessitating an awkward balancing or tilting of the book with the book or books in each instance being gravity held firmly against one or the other of the book end members. Incidentally, it will of course be appreciated that tape cartridges and the like can also be retained within the rack. This ability to positively and safely retain books or the like against a fixed book end is derived from the orientation of the upper surface of the base member at an incline down which the book is slid for engagement against the corresponding end member.

Upon an inverting of the device, the inclined base member now defines an upwardly directed wide through supported in an elevated position by the now depending end members. The base member, so orientated, is particularly adapted so as to support an open book for easy viewing of the contents thereof. In a variation, the inverted stand will transversely incline to a slight degree for a facilitation of the viewing of the contents of an open book supported thereon.

The foregoing is considered illustrative of the principles of the invention. Further, since modifications and changes may readily occur to those skilled in the art, it is not desired to limit the invention to the exact construction and operation shown and described. Accordingly, all suitable modifications and equivalents may be resorted to, falling within the scope of the invention as claimed.

What is claimed is:

1. An invertible book retaining stand comprising a unitary book receiving base member, said base member having opposed ends, a planar end member rigidly fixed to each of the opposed ends of the base member and angularly directed relative thereto to one side thereof and terminating in an outer end edge, the end members being of equal height, said base member comprising a first portion which, when upwardly directed, defines two rigidly joined angularly related planar sections oppositely inclined downwardly and outwardly from an intermediate location along the length of the base member to the opposted ends thereof, said end members, when the first portion of the base member is upwardly directed, projecting upwardly to a vertical height above that of the intermediate location and defining a bookend-type abutment against which a section supported upright book will engage and be maintained, said base member having a second portion which, when upwardly directed upon an inverting of the stand, is defined by two angularly related planar sections oppositely inclined upwardly and outwardly from an intermediate location along the length of the base member to the opposed ends thereof for reception of an open book thereon, said end members, when the second portion of the base member is upwardly directed, projecting downwardly and defining base member elevating legs, the planar sections of the first portion and the second portion being of approximately equal length, the outer end edge of each end member being inclined, said retaining stand, when inverted with the second portion upwardly directed, having said second portion transversely inclined between the opposed edges thereof.

2. The book retaining stand of claim 1 wherein said base member is defined by laterally spaced parallel rod lengths, the opposed ends of each rod length being laterally bent to form approximately vertical rod sections which define said end members.

3. The book retaining stand of claim 2 wherein the rod sections of each end member are joined at the outer ends thereof by a transverse rod section defining the outer end edge.

* * * * *